US011612241B2

(12) United States Patent
Schneiderman

(10) Patent No.: US 11,612,241 B2
(45) Date of Patent: Mar. 28, 2023

(54) PORTABLE AND STACKABLE UMBRELLA STAND AND TABLE AND METHODS OF USE THEREOF

(71) Applicant: OJUSBERRCAL LLC, Palm Beach Gardens, FL (US)

(72) Inventor: Charles Schneiderman, Palm Beach Gardens, FL (US)

(73) Assignee: OJUSBERRCAL LLC, Palm Beach Gardens, FL (US)

( * ) Notice: Subject to any disclaimer, the term of this patent is extended or adjusted under 35 U.S.C. 154(b) by 317 days.

(21) Appl. No.: 17/065,105

(22) Filed: Oct. 7, 2020

(65) Prior Publication Data

US 2022/0104614 A1 Apr. 7, 2022

(51) Int. Cl.

| | |
|---|---|
| ***A47B 37/04*** | (2006.01) |
| ***A45B 23/00*** | (2006.01) |
| ***E04H 12/22*** | (2006.01) |

(52) U.S. Cl.

CPC ..... *A47B 37/04* (2013.01); *A45B 23/00* (2013.01); *E04H 12/2246* (2013.01); *A45B 2023/0012* (2013.01); *A45B 2200/1063* (2013.01)

(58) Field of Classification Search

CPC ..... A47B 37/04; A45B 2200/1063; A45B 2200/1009; A45B 2023/0012; E04H 12/2246

(Continued)

(56) References Cited

U.S. PATENT DOCUMENTS 2,883,247 A * 4/1959 Thompson ..... E04H 12/2238 D3/10

1,148,455 A 4/1979 Oliver (Continued)

FOREIGN PATENT DOCUMENTS

FR 2756702 A1 6/1998

OTHER PUBLICATIONS

The Hot Mess Kitchen, DIY Umbrella Stand, (8 Pages Total) https://www.thehotmesskitchen.com/2017/06/05/diy-umbrella-stand/, (as viewed Mar. 31, 2020).

*Primary Examiner* — Jose V Chen

(74) *Attorney, Agent, or Firm* — ArentFox Schiff LLP

(57) ABSTRACT

A portable and stackable combination umbrella stand and table system comprised of a stand housing interoperable with a first lid portion to cover an opening in an umbrella securing body and a second lid portion to serve as a table top. The stand housing may be configured to form a concave area for receiving sand or other ballast to securely anchor the system in an upright position. As the concave area of the stand housing is filled with sand or other ballast, the first lid portion may serve as a cap by covering the upper portion of the umbrella securing body and prevents the ingress of sand or other ballast material from entering the channel (through which the umbrella pole may thereby be more easily inserted). The first lid may be removed to receive an umbrella within the umbrella securing body, and the second lid portion, which may be configured to be installed with the stand so as to form a table surface, may thereby facilitate snacking once ballast has been received. The housing is shaped so as to facilitate stacking of multiple systems. A variety of other features may be provided, including hooks and other retaining and storage features formed within or attached to the system, as well as a carrying handle and (Continued)

latches to secure the table top lid, any or all of which are designed for both personal and commercial use.

22 Claims, 13 Drawing Sheets

(58) Field of Classification Search
USPC ..... 108/50.12; 135/16, 96
See application file for complete search history.

(56) References Cited

U.S. PATENT DOCUMENTS 4,148,455 A * 4/1979 Oliver ..... E04H 12/2246 248/524
4,296,693 A 10/1981 Archer
4,832,163 A * 5/1989 Levesque ..... A45B 3/00 108/14
5,207,406 A 5/1993 Stine et al.
5,582,471 A * 12/1996 Lin ..... B65F 1/14 108/150
5,718,178 A * 2/1998 Smith ..... A47B 37/04 297/188.09
5,967,359 A * 10/1999 Mindell ..... A47B 37/04 220/478
6,065,466 A * 5/2000 Baykal ..... A47J 37/0781 126/41 R
6,161,333 A * 12/2000 Poston ..... A01G 9/02 47/86
6,199,818 B1 * 3/2001 Tsappi ..... A01G 9/124 248/524
6,895,982 B1 5/2005 Shaw
7,007,813 B2 * 3/2006 Yang ..... F25D 3/08 211/131.1
7,322,300 B2 * 1/2008 Caeton ..... A47B 37/04 108/90
7,537,015 B1 * 5/2009 Molnar, IV ..... A47B 37/04 108/50.13
8,733,254 B1 * 5/2014 Wakefield ..... A47B 37/04 108/50.11
8,789,549 B1 * 7/2014 Barnes ..... E04H 12/2246 135/114
9,974,369 B1 5/2018 Depaolo et al.
10,244,852 B1 4/2019 Donaldson
11,344,113 B1 * 5/2022 Martin ..... A47B 37/04
2005/0034638 A1 * 2/2005 Li ..... A47B 11/00 108/50.12
2008/0272109 A1 * 11/2008 Bland ..... A47B 37/04 219/218
2009/0101046 A1 4/2009 Zak et al.
2009/0165681 A1 * 7/2009 Smith ..... A47B 37/04 108/50.12
2010/0107488 A1 * 5/2010 King ..... A01G 13/0212 47/20.1
2011/0000132 A1 * 1/2011 Kamau ..... A01G 9/02 47/66.7
2012/0017960 A1 * 1/2012 Doell ..... E04H 15/58 135/120.1
2012/0090525 A1 * 4/2012 Montgomery ..... B63B 22/20 405/219
2013/0067810 A1 * 3/2013 Kamau ..... A01G 9/022 220/676
2013/0341988 A1 * 12/2013 Walker ..... A47C 9/00 297/452.65
2014/0096707 A1 * 4/2014 Westbrook ..... A47B 13/00 108/50.13
2014/0227920 A1 * 8/2014 Lovett ..... A45B 3/00 441/1
2015/0159394 A1 * 6/2015 Oliveira ..... A01K 97/10 135/15.1
2015/0240515 A1 * 8/2015 Davis ..... A47B 37/04 256/1
2015/0250305 A1 * 9/2015 Kahler ..... A47B 13/088 108/50.13
2016/0081444 A1 3/2016 Munsch
2016/0123335 A1 * 5/2016 Molnar, IV ..... A47B 37/04 108/50.01
2016/0166109 A1 * 6/2016 Banal ..... A47B 11/00 108/50.13
2017/0022730 A1 * 1/2017 Mansueto ..... E04H 12/2238
2017/0101799 A1 * 4/2017 Koerner ..... E04H 12/2246
2017/0302101 A1 * 10/2017 Varacek ..... H02S 20/30
2019/0277506 A1 * 9/2019 Hackley ..... A47F 9/00
2020/0128955 A1 * 4/2020 Molnar ..... F24F 1/03
2020/0191407 A1 * 6/2020 Zemel ..... F24B 1/192
2021/0112973 A1 * 4/2021 Lamb ..... F24C 15/36
2021/0214961 A1 * 7/2021 Gharabegian ..... A45B 23/00
2022/0196247 A1 * 6/2022 Ressler ..... F24B 3/00

* cited by examiner

PORTABLE AND STACKABLE UMBRELLA STAND AND TABLE AND METHODS OF USE THEREOF

TECHNICAL FIELD

Aspects of the present disclosure relate to systems and methods of use thereof for portable combination stackable umbrella stands/tables.

BACKGROUND

When an individual or group of individuals participate on an expedition, excursion, or vacation to any of a variety of outdoor or other locations, such as beaches or parks, that individual or group may often desire to protect themselves from potentially harmful environmental elements they may not otherwise encounter indoors, such as ultraviolet (UV) radiation from the sun or rain. Thus, it is common for individuals to take an umbrella with them on such trips, so that when they reach their intended destination they may sit, rest, and read, among other things, and are capable of arranging the umbrella to create a small sheltered area. However, due to the unstable or unpredictable terrain often encountered in outdoor environments, those individuals often have difficulty arranging their umbrella in the open position, such that the umbrella does not move or otherwise fall from where it was arranged originally, due to environmental elements, such as wind, or more human related forces, such as the impact of a stray beach ball. Further, on these outdoor vacations or excursions, it is common for individuals to include a picnic or snack among the list of favorite activities for which the individual or group may engage.

A number of different approaches have been used in the past to attempt to address one or more of these issues, but all remain unsatisfactory and/or impractical or awkward to implement and/or use, for example. U.S. Pat. No. 4,832,163 titled A Portable Table System discloses a system comprised of two separate half containers face-to-face to hold a pole in between the two halves, but without the ability to hold different width poles, for example, and lacking numerous other needed features. U.S. Pat. Publ. No. 2015/0159394 titled Umbrella Bucket discloses a system having a separate tube requiring assembly that is inserted through an opening in a lid into a raised retainer ring in the bottom bucket and an umbrella pole that is inserted into this separate tube. Additional tubes and multiple pieces with angular extensions, also requiring assembly, are shown as hold fishing poles. U.S. Pat. No. 4,148,455 titled Stands For Tubular Articles discloses use of a raised button in the bottom of a bucket to catch an umbrella pole but fails to disclose, for example, features for separating the contents of the bucket with the pole. U.S. Pat. No. 6,895,982 titled Carriable Storage Bucket for Supporting a Raised Umbrella discloses a device that has a PVC pipe attached inside the bottom of a bucket with coupler fittings and a threaded connector, with and a T-shaped PVC support member is attached higher in the bucket with intricate small hardware.

U.S. Pat. No. 4,296,693 titled Beach Umbrella Support discloses an umbrella support that is formed by placing the umbrella shaft into a collapsible rectangular beach bag container, which can be filled with solid or liquid material, and separate corner rods used for additional stability. U.S. Pat. Publ. No. 2016/0081444 A1 titled Vertical Support Base & Anchoring System includes a ballast container and a separate base plate with parallel mounting brackets having holes for insertion of retaining bolts, and corner elements and other support cross type bars. U.S. Pat. No. 10,244,852 titled Beach Equipment Carrier and Locating Pole discloses a dual function bucket article carrier is converted into a position marker with multiple members (tubes, poles, etc.) whereby the smaller member slides with an intermediate member that slides with a larger base member that attaches to the bottom of the bucket with lock pins in holes to connect the members; a sleeve is centered in a bucket while it is filled with sand; and a lid with a hole is connected to the bucket. U.S. Pat. No. 9,974,369 titled Apparatus For Anchoring An Umbrella discloses a container base and a cylindrical male attachment member medially attached and upwardly extended from a flattened middle portion of the container base, whereby the threaded exterior portion of the umbrella shaft is selectively threadable with the inner threaded cavity of the cylindrical male attachment member. U.S. Pat. No. 5,207,406 titled Umbrella Stand discloses utilizing a shaft mounted socket arrangement with fasteners to allow an angulated position by unlocking and relocking. FR Pat. No. 2756702 A1 titled Garden Planter and Parasol Support discloses a topless and closed bottom with shaped stationary unstackable planter filled with dirt and capable of holding a parasol.

U.S. Pat. Publ. No. 2009/0101046 titled Cooler Table discloses a table comprised of a cool storage compartment under the tabletop, and the tabletop is changeable between a closed position; and, by its mounting on a post, extends to a higher table position above the exposed storage compartment. An article titled "DIY Umbrella Stand (see http://www.thehotmesskitchen.com/2017/06/05/diy-umbrella-stand/ as viewed on Mar. 31, 2020, discusses a do-it-yourself umbrella stand merely describes a paint bucket and cover with just a slit in the top through which a pole or pipe is thrust through.

SUMMARY

Consequent of the various situations and aspects described above, as well as others, there remains an unmet need for a portable and stackable combination umbrella stand and table system, and methods of use thereof, that may allow outdoor enthusiasts and others (in either personal use or commercial use, for example) to remain sheltered from environmental elements while eating snacks or full picnic meals outside at a beach, park, or mountain trail, for example. Such a system may also allow, for example, other uses, such two such umbrella stands being spaced apart so that a net may be strung across two opposite poles (each placed within a stand) for use in playing volleyball, badminton, and similar games.

In view of the above problems and shortcomings, as well as others, aspects of the present disclosure relate, among other things, to a portable and stackable combination umbrella stand and table and methods of use thereof. The portable and stackable combination umbrella stand and table system may comprise a stand housing interoperable with a first lid portion (also referred to herein as a "cap") and a second lid portion, which may be used as a table top, for example. The stand housing may be configured to form an internal concave area and may include an outer (e.g., lateral) wall portion extending from a first walled end (e.g., stand top when the stand is upright) to a second walled end (e.g., stand bottom when the stand is upright), wherein the first walled end may be selectively closable by the second lid portion and the second walled end may include a closed end portion, which may serve as a base of the system. Further, the stand housing may also include a conically shaped umbrella securing body for receiving an umbrella pole, for example, extending along a central axis of the stand within the concave area of the housing. In one example, the securing body may extend from a first end contiguous with the closed end portion of the stand housing (e.g., lower end), to a second end (e.g., upper end). The securing body may include a channel extending along the central axis from a first opening located at the first end of the securing body to a second opening at the second end. The first lid portion may be used to close the second opening in the securing body to prevent the ingress of sand or any other ballast material into the channel, for example, during receipt of the sand or other ballast material within the concave area of the stand housing body.

The second lid portion may serve as a tabletop portion that may be selectively locatable on the stand housing so as to enclose the concave area of the housing. The second lid portion may also include an opening that aligns with the second (e.g., upper end) opening of the umbrella securing body when the second lid portion is located on the stand body. The communication of the second opening of the securing body and the opening of the second lid portion may allow an umbrella pole to pass therethrough, such that the umbrella may be securely anchored within and/or through the stand and table system, while also allowing for the second lid portion to operate as a table surface for activities such as snacking.

In one example, the portable stackable combination umbrella stand and table system may also include one or more ring-shaped securing portions, each having a central opening of varying diameters. The ring-shaped securing portions may be emplaced within the channel of the securing body (e.g., at the upper end and/or at the lower end of the channel), such that differing diameter umbrella poles may securely and snugly received within the opening in the channel.

A variety of other features may also be provided, including hooks and other retaining and storage features formed within or attached to the system as well as a carrying handle and latches to secure the table top lid.

Additional advantages and novel features of these aspects will be set forth in part in the description that follows, and in part will become more apparent to those skilled in the art upon examination of the following upon learning by practice of the disclosure.

DETAILED DESCRIPTION

The detailed description set forth below in connection with the appended drawings is intended as a description of various configurations and is not intended to represent the only configurations in which the concepts described herein may be practiced. The detailed description includes specific details for the purpose of providing a thorough understanding of various concepts. However, it will be apparent to those skilled in the art that these concepts may be practiced without these specific details.

Throughout the disclosure, the term approximately may be used as a modifier for a geometric relationship among elements or for the shape of an element or component. While the term approximately is not limited to a specific variation and may cover any variation that is understood by one of ordinary skill in the art to be an acceptable variation, some examples are provided as follows. In one example, the terms approximately may include a variation of less than 10% of the dimension of the object or component. In another example, the term approximately may include a variation of less than 5% of the object or component. If the term approximately is used to define the angular relationship of one element to another element, one non-limiting example of the term substantially or approximately may include a variation of 5 degrees or less. These examples are not intended to be limiting and may be increased or decreased based on the understanding of acceptable limits to one of skill in the relevant art.

For purposes of the disclosure, directional terms are expressed generally with relation to a standard frame of reference when the system and apparatus described herein are installed in an in-use orientation. In order to provide context to the current disclosure, a broad overview of the discovered deficiencies of various systems and an example implementation of the current disclosure and the advantages provided by the disclosure are described below. Further details of example implementations of the current disclosure are described in detail with reference to the figures below.

Figure 1A:
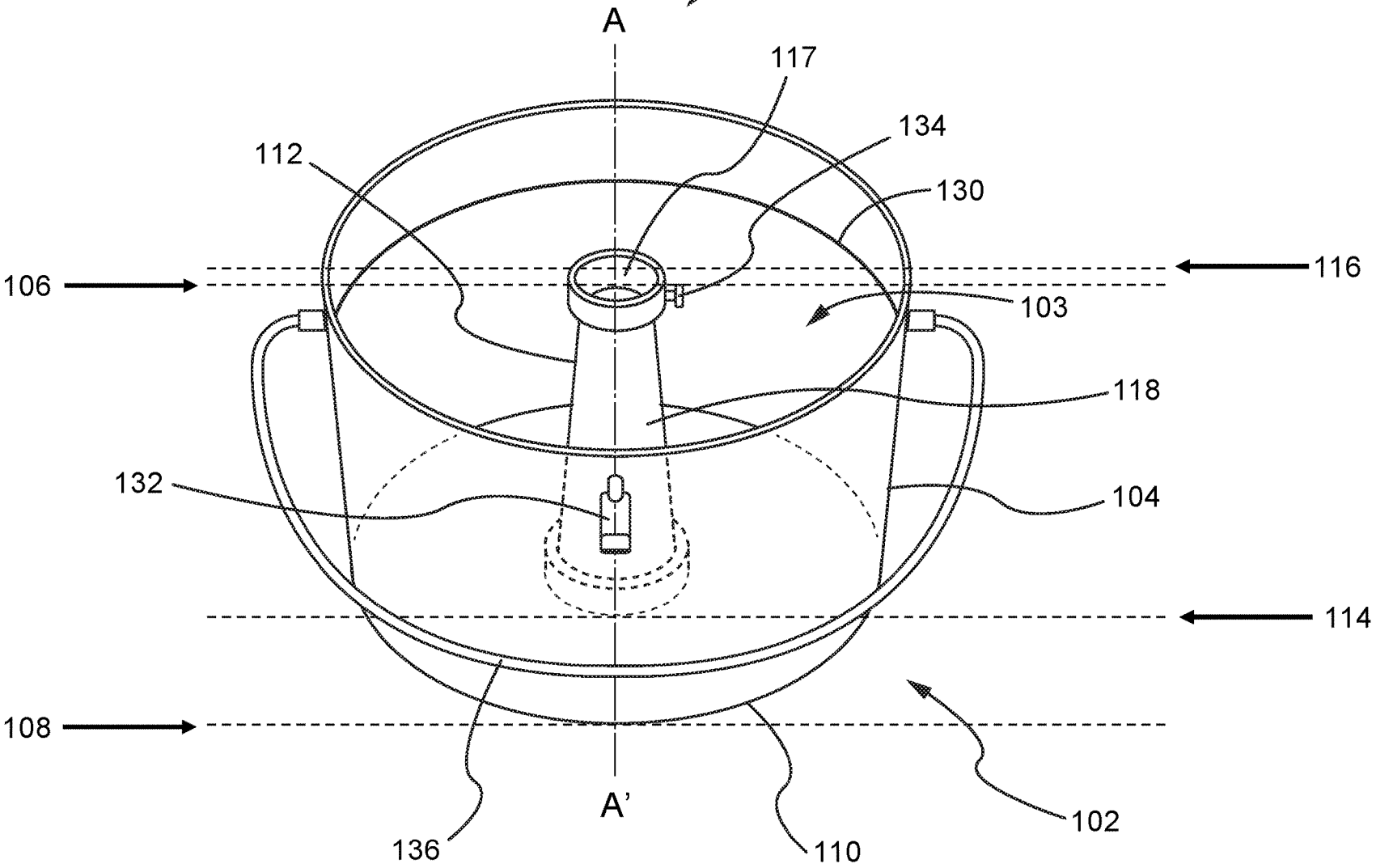
FIG. 1A illustrates a view of various features of an example combination umbrella stand and table system in accordance with aspects of the present disclosure.
Figure 1B:
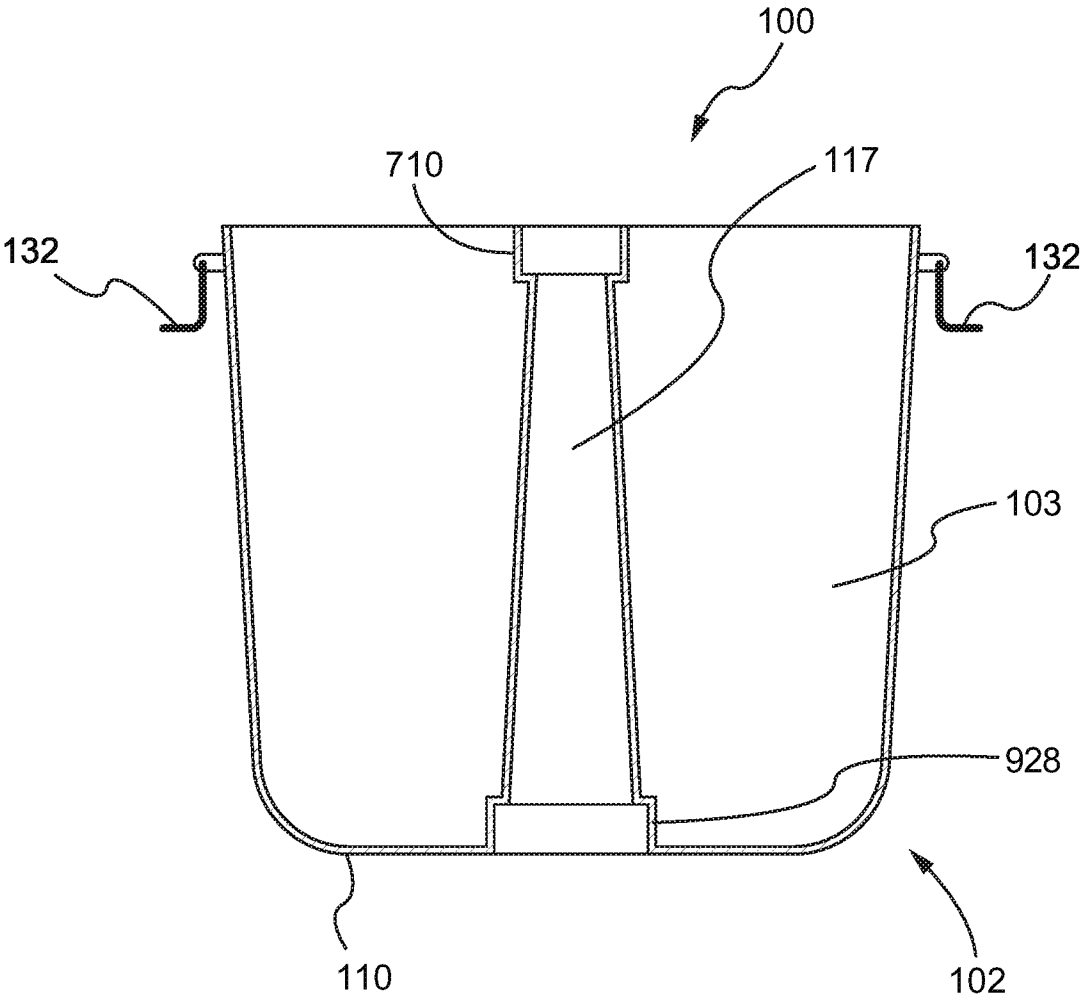
FIG. 1B presents a representative vertical cross-sectional view of various features of the example combination umbrella stand and table system of FIG. 1A.

According to aspects of the present disclosure, FIG. 1 illustrates various features of an example combination umbrella stand and table system 100, in accordance with aspects of the present disclosure. FIG. 1B presents a representative vertical cross-sectional view of various features of the example combination umbrella stand and table system of FIG. 1A. The combination umbrella stand and table system 100 may include a stand housing 102, such as a walled side portion that may have any suitable cross-sectional shape, such as the circular cross-sectional shape shown in FIG. 1A, wherein the stand housing 102 may be selectively interoperable with a first lid portion (see, e.g., lid portion may be emplaced on lip collar 200 of FIG. 2A, which may extend about a securing body 112, as described further below) and/or a second lid portion that may serve as a tabletop (e.g., lid portion 300 of FIG. 4). Note that the walled side portion of housing 102 may also have other cross-sectional shapes, such as a square, rectangular, triangular, octagonal, or oval cross-sectional diameter, among others. The stand housing 102 may be configured to include a generally concave inner housing area 103. Area 103 may be configured to receive an ingress of ballast material, such as sand, water, or gravel, so that the system 100 may be further anchored relative to a surface upon which the system 100 is emplaced, due to the weight of the ballast. Consequently, stand housing 102 may include an outer (e.g., lateral) wall portion 104, wherein the outer wall portion 104 may extend from a first walled end 106 (e.g., at the top of the housing 102, as shown in FIG. 1A) to a second walled end 108 (e.g., at the bottom of the housing 102, as shown in FIG. 1A). The first walled end 106 may be selectively closable, for example, by a second lid portion (e.g., lid portion 300 of FIG. 4), described in further detail below. The second walled end 108 may be configured such that a closed end portion 110 (e.g., a bottom of the housing 102, as shown in FIG. 1A) may extend from the second walled end 108 of the outer wall portion 104. Note that the interface at the second walled end 108 of the housing 102 between the outer wall portion 104 and the closed end portion 110 may be contoured at its interface (e.g., curved at the edges of end portion 110 and wall portion 104; see also FIG. 1B); further note that the end portion 110 may likewise include contours, such as partially curved portions or continuous curvature, such as from the outer edge of the end portion 110 toward its center (e.g., area proximal to axis A-A' of system 100; also see FIG. 1B).

Figure 2A:
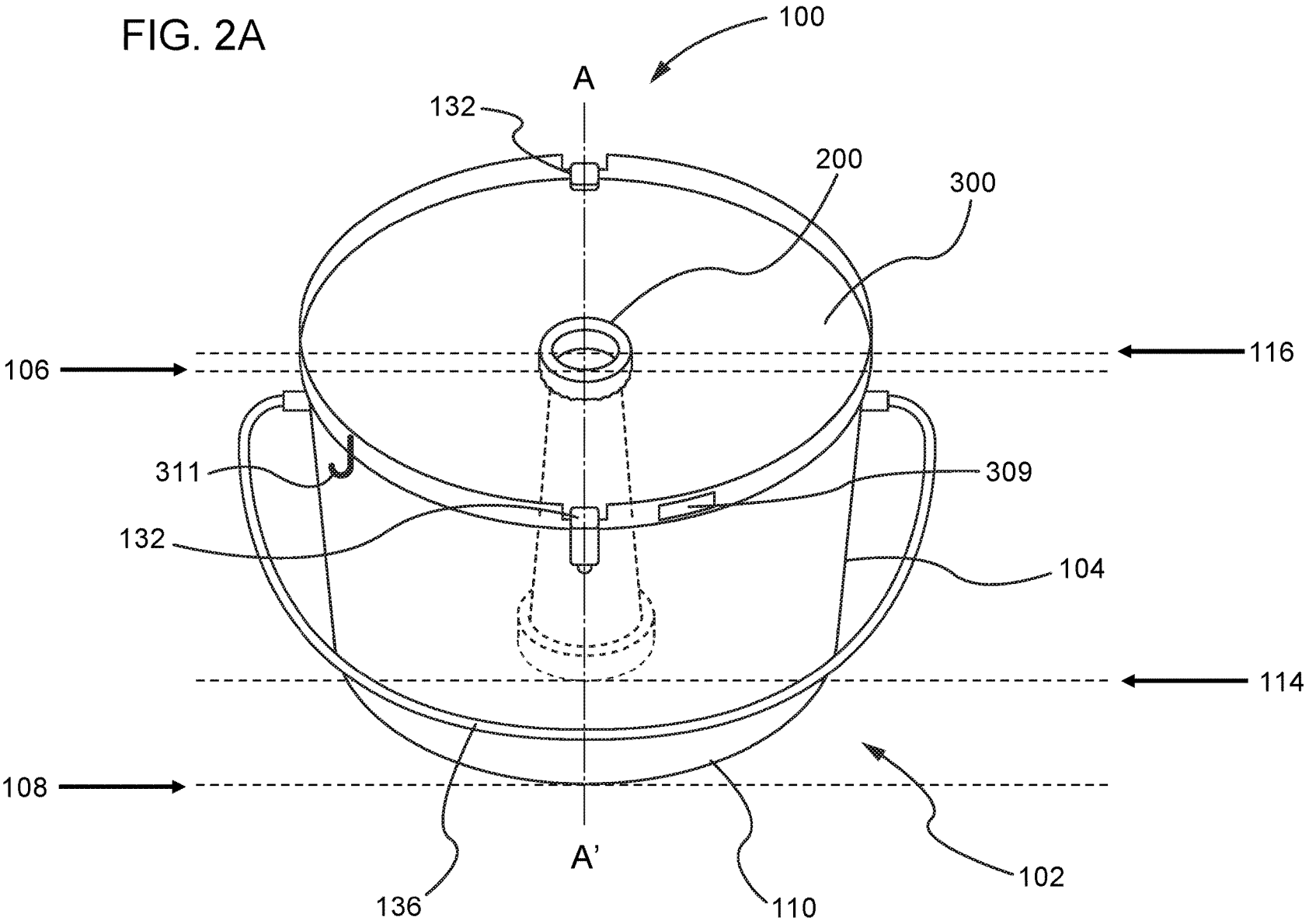
FIG. 2A shows a view of various aspects of the example combination umbrella stand of FIG. 1 with which an example removable lid or cap may be engageable with an umbrella securing body of the umbrella stand and table system, in accordance with various aspects of the present disclosure.

Further, the housing stand 102 may additionally comprise or have attached thereto a securing body 112, which may, for example, have a generally conical outer shape, as shown in FIG. 1A, wherein the securing body 112 may be configured to extend along a central axis A-A' (FIG. 2A). Securing body 112 may be located within area 103 of the stand housing 102. The securing body 112 may extend from a first end 114 to a second end 116, wherein the portion of the securing body 112 at the first end 114 may be contiguous with the closed end portion 110 of the housing 102, and further wherein the first end 114 of the securing body may align with (e.g., fall within the same plane or be proximal to the plane of) the second walled end 108 of the housing 102. The second end of 116 of the securing body 112 may align with (e.g., fall within the same plane or be proximal to the plane of) the first end 106 of the housing 102. Further, the securing body 112 may be configured to include a channel 117, such that channel 117 may extend approximately along at least a portion of the axis A-A'. In the example implementation shown in FIG. 1A, the channel 117 may be approximately one and three-quarter inches in diameter so as to be sized to receive a common size beach umbrella pole (e.g., umbrella pole 228*a* shown in FIG. 2B).

The channel 117 of securing body 112 may allow for the system 100 to receivably engage and stabilize an umbrella pole for an umbrella (see e.g., umbrella pole 228*a* of umbrella 228 shown in FIG. 2B) to be used therewith. The channel 117 may extend from a first opening end located approximately at the first end 114 of the securing body 112, to a second opening end located approximately at the second end 116 of the securing body 112. In one example, the channel 117 may be configured to be at least partially tapered, such that the portion of channel 117 proximal to the first end 114 may include a larger cross-sectional diameter that tapers along axis A-A' to a smaller cross-sectional diameter (e.g., at or near location 118; see also FIG. 1B) that corresponds to a diameter at the opposite end of channel proximal to the second end 116.

Figure 3:
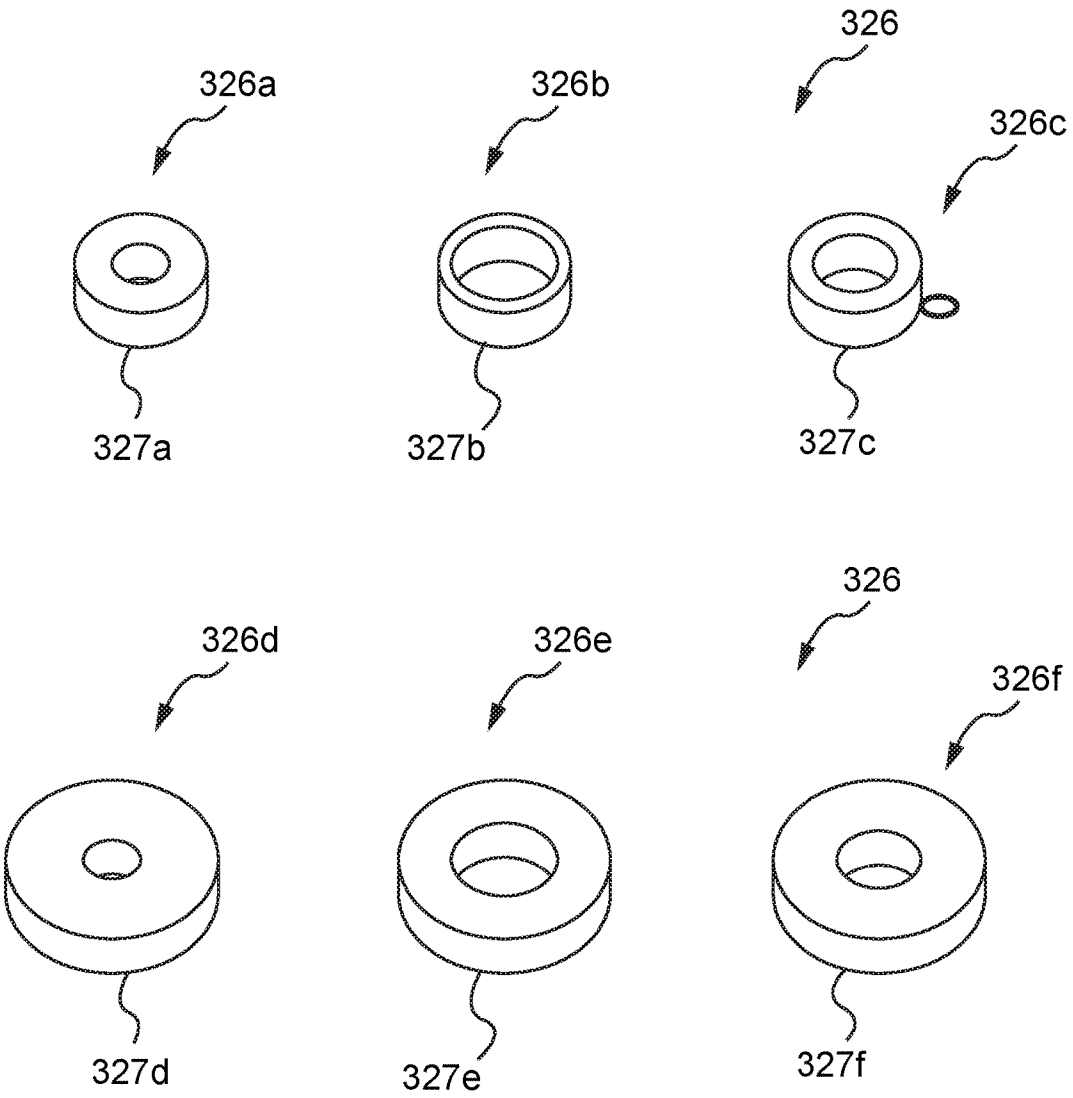
FIG. 3 shows perspective views of three example securing (e.g., upper, lip collar) fitting rings and three example securing (e.g., lower, bucket underface) fitting rings for selective use with various features of an example combination umbrella stand and table system, in accordance with aspects of the present disclosure
Figure 4:
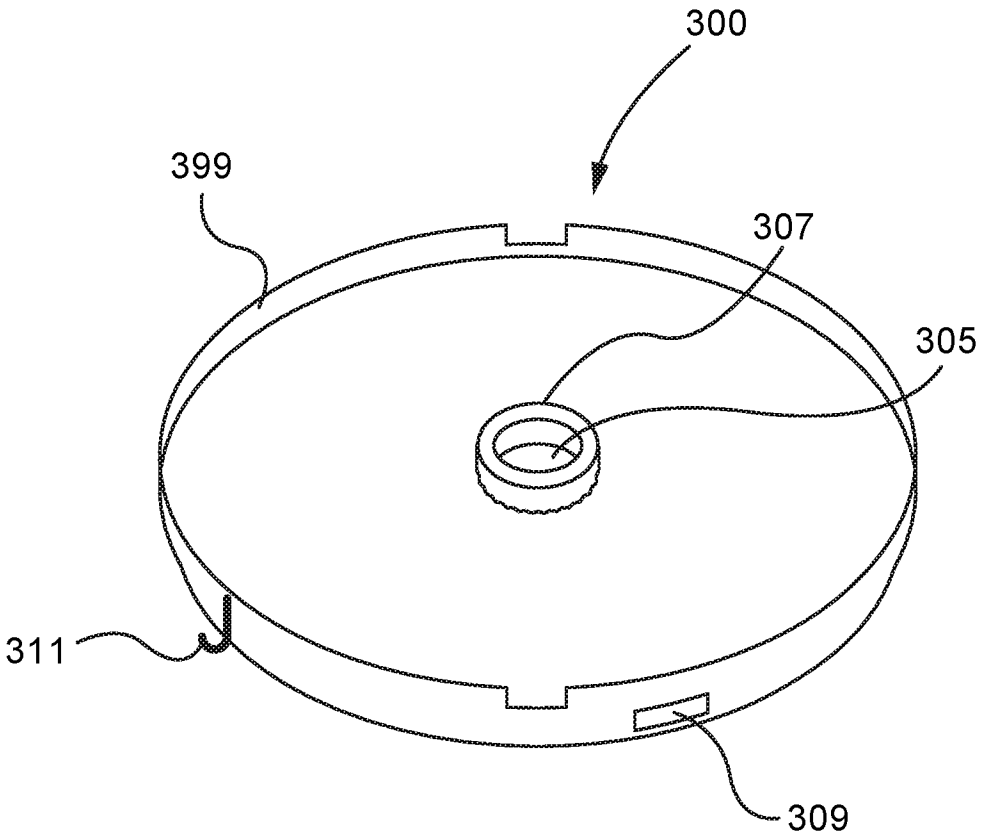
FIG. 4 shows various features of an example lid selectively usable for enclosing the housing of an example combination umbrella stand and table system, in accordance with various aspects of the present disclosure.

Other features of the example system 100 of FIG. 1A may include the following. The example housing may be about a 10½ inches in cross-sectional diameter at the bottom, approximately 15 inches in cross-sectional diameter at the top, and have a height of approximately 12 inches with a lid (e.g., second lid portion 300 of FIG. 4) in place. After the bucket is filled, the first lid portion (e.g., which may be emplaced on lip collar 200 of FIG. 2A), also interchangeably referred to herein as a "cap," may be removed and placed in a temporary storage feature within the periphery of the second lid portion (e.g., slot 309 in lid portion 300 of FIG. 4), for example. The wall of the securing body 112 may be thicker than the outer wall portion 104 of the stand housing (FIG. 1A) and may be approximately one inch thick and may be hollow, or semi-solid (e.g., honeycomb chambered), or fully solid for additional support (e.g., in the area surrounding the central channel 117 as shown in FIG. 1A). An indented fill line 130 may be located proximal to the top of the stand for designating a limit for received sand or water. Additionally, as shown in FIG. 4, for example, a slot 309, hook 311, or other retaining feature may be provided for retaining the cap (see e.g., cap 400, 405 of FIGS. 2A, 2C, 2E) and or the fitting rings 326 (FIG. 3). In addition, a screw 134 receivable in an opening in the securing body 112 may be provided to further securably help a received umbrella pole (e.g., umbrella pole 228*a* shown in FIG. 2B) within the securing body 112. Also shown is an example latch 132 (FIG. 2A) and an example carrying handle 136 (FIG. 1A) to facilitate transport of the system 100.

Figure 7A:
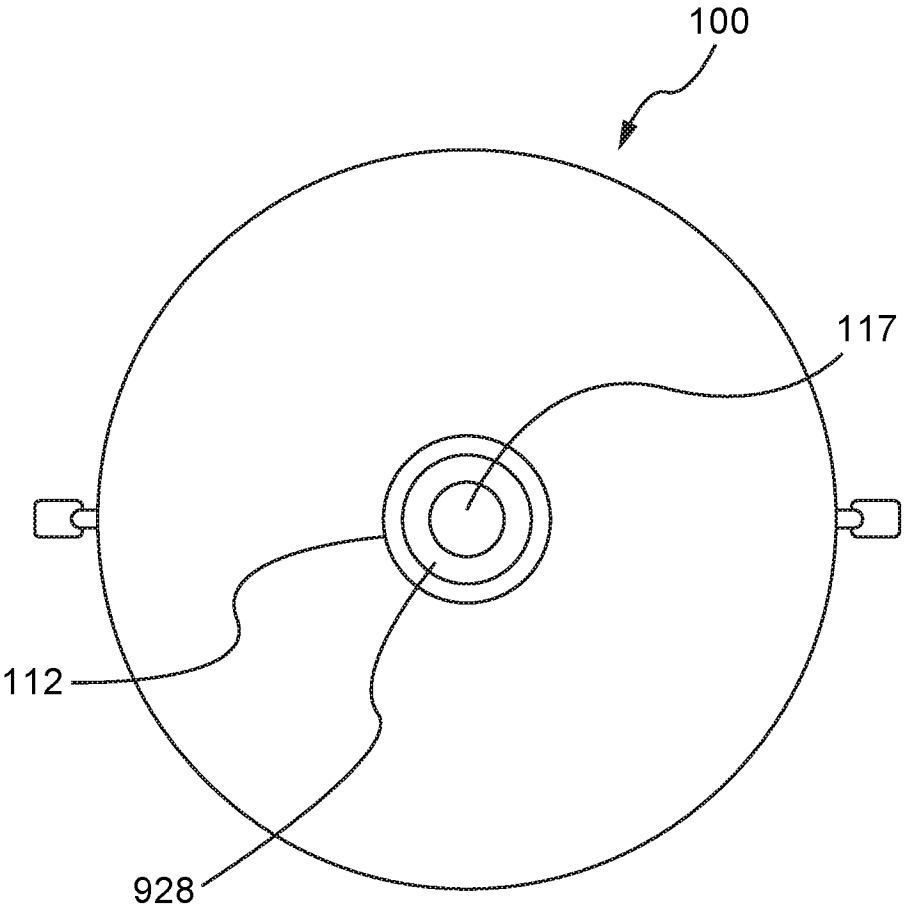
FIG. 7A shows a view of the lower surface of an example combination umbrella stand and snack table system, in accordance with aspects of the present disclosure.

In another example, partially tapered channel 117 may further be configured to interoperate with one or more securing ring portions (see e.g., securing ring portions 326 shown in FIG. 3), wherein each of the securing ring portions may be selectively engageable with the securing body 112, such as within shelf 710 of the lip collar (FIG. 1B) and/or within an underneath shelf (e.g., shelf 928 of FIGS. 1B and 7A) and/or at a location proximal to location 928 (see also FIG. 1B), so that the securing ring portions may at least partially close the channel 117 at or near locations 710 and/or 928 (FIGS. 1B and 7A). The securing ring portions (e.g., ring portions 326 of FIG. 3) with differing sized inner openings may be sized on the outer edges to match the upper and lower locations, but with the smaller outer diameter rings for the upper (lip collar) and larger outer diameter rings for the lower (undersurface) being dimensioned to facilitate the interoperation of system 100 with a plurality of different size umbrella poles (e.g., one example of which is pole 228*a* of FIG. 2B). Consequently, as shown in FIG. 3, securing ring portions 326 may be configured to be substantially circular in cross-sectional shape, wherein each of the plurality of securing ring portions 326*a*, 326*b*, 326*c*, 326*d*, 326*e*, 326*f*, may include a different sized opening 327*a*, 327*b*, 327*c*, 327*d*, 327*e*, 327*f* therein. In one example, each of the upper ring portions 326*a* and 326*b* may be configured to have an outer diameter sized for a slight interference fit with the channel 117 (e.g., at or near location 710 of FIG. 1B) and an inner opening (e.g., openings 327*a*, 327*b*) having a diameter that corresponds to and matches the inner diameter openings of the lower fitting rings 326*d*, 326*e*, and 326*f* (e.g., when placed at or near location of shelf 928 of FIG. 1B), and similarly corresponds to a variable outer diameter of an umbrella pole (e.g., pole 228*a* of FIG. 2B) to be received therein. In use, each of the securing ring portions 326 may thereby receive the corresponding appropriate outer shaft diameter of the pole of an umbrella (e.g., one example pole 228*a* diameter being shown in FIG. 2). Ring portion 326*c* has an alternative style cap-like fitting ring with a central opening and a peripheral eye extension, which such fitting ring may, for example, be sized to engage and cover the lip collar 200 (FIG. 2A). Optionally, ring portion 326*c* (FIG. 3) may include an eye extension to facilitate storage, such as hanging from a hook. Further, while some of the ring portions (e.g., ring portions 326*a* and 326*b*) shown in FIG. 3 may be designed and sized to receivably fit within the shelf 710 of the lip collar 200 (FIGS. 1B and 2A), the ring portions may alternatively be sized and shaped so as to fit about the outer edge of the lip collar 200 (FIGS. 1B and 2A), similar to cap 400 of FIGS. 2C and 2D, but with an opening therein for receiving an umbrella pole. The ring portions 326, when unengaged with the channel may be stored, for example, via engagement onto one or more of the hooks or other storage features of the system.

In one example, the stand housing 102 may further be configured to be stackably engageable with a second stand housing (not shown in FIG. 1A) such as via the insertion of the securing body 112 of the stand housing 102 into the at least partially tapered channel (not shown in FIG. 1A) of a second stand body (not shown in FIG. 1A). Similarly, the lid 300 (FIG. 4) and the dual-layered lid 800 (FIG. 8) may further be configured to be stackably engageable with a second set of lids (not shown in FIG. 4 or FIG. 8).

Figure 5:
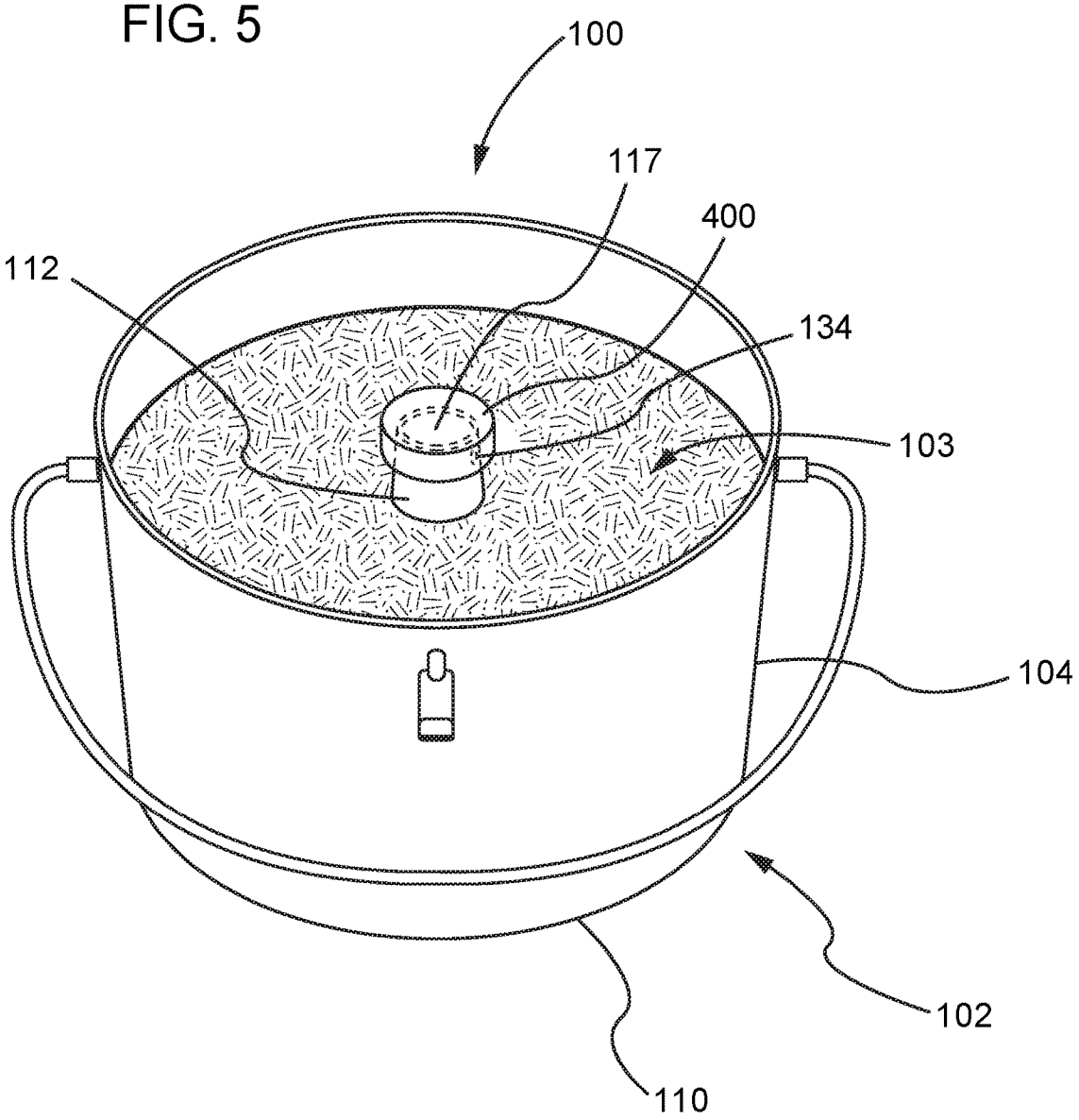
FIG. 5 shows another view of an example combination umbrella stand and table system with a lid (cap) engaged therewith, in accordance with aspects of the present disclosure.

As further illustrated in FIG. 2A and FIG. 5, the combination umbrella stand and table system 100 may further be designed for an option for selective emplacement of a first lid portion 400 (FIGS. 2C and 2D) or 405 (FIG. 2E) thereon, wherein first lid portion (400 or 405) may be selectively engageable with the securing body 112 at or proximal to its second end 116, so that the emplaced first lid portion 400, 405 may thereby prevent ingress of sand, gravel, water, or other similar ballast material into the channel 117, such as during receipt of the ballast material into the concave area 103 of the stand housing 102. For example, such ballast material may be poured or shoveled (e.g., sand or water from a beach area of use) into the concave area 103 of the stand housing 102 once the system 100 is located in a suitable location for use (e.g., at a beach or pool). The addition of such ballast material may help anchor the system 100 from being toppled, such as when a strong breeze may impact the emplaced umbrella, tending to otherwise cause the stand/table to be more easily overturned.

Figure 2B:
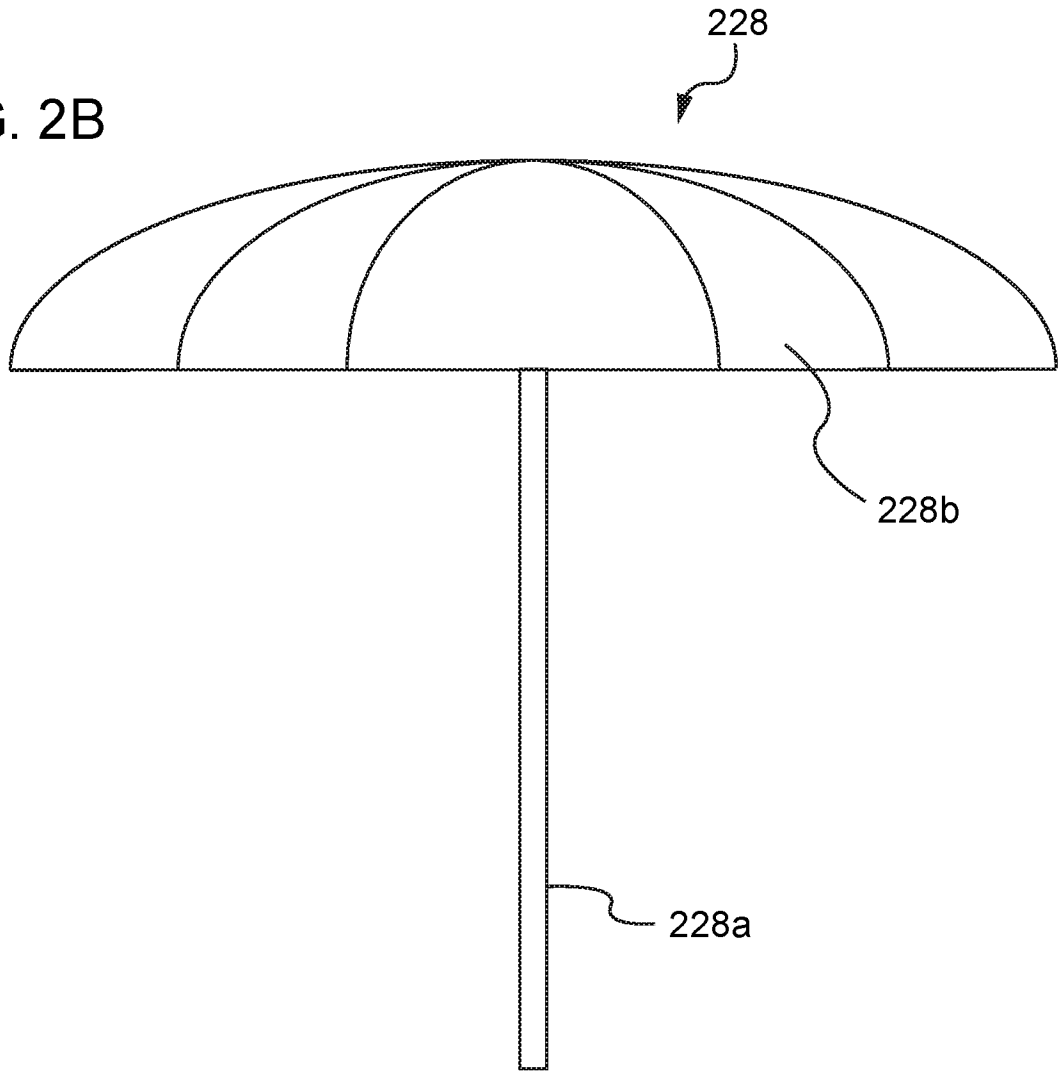
FIG. 2B shows an example umbrella usable with a combination umbrella stand and table system, in accordance with various aspects of the present disclosure.

FIG. 2B shows an example umbrella 228 having an umbrella pole 228*a* and a canopy 228*b*, the umbrella 228 being usable with a combination umbrella stand and table system, in accordance with various aspects of the present disclosure.

Figure 2E:
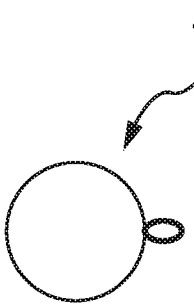
FIG. 2E shows an overhead view of an example alternate lid or cap with an extension eye (to be tethered to or placed onto one of the peripheral hooks of the umbrella stand and table system when said cap is unengaged) in accordance with various aspects of the present disclosure.
Figure 2C:
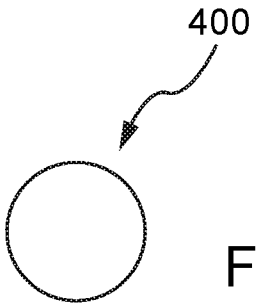
FIGS. 2C and 2D show an overhead and cross-sectional views, respectively, of an example lid or cap engageable with an umbrella securing body of the umbrella stand and table system, in accordance with various aspects of the present disclosure.
Figure 2D:
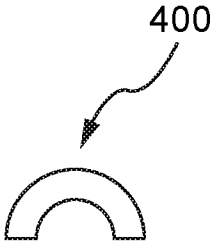

FIGS. 2C and 2D show overhead and cross-sectional side views, respectively, of the example first lid portion 400 usable of FIG. 2A. As shown in FIG. 2C the first lid portion 400 may be generally circular in horizontal (e.g., emplaced) cross-sectional shape so as to be usable to cover the circular cross-sectionally shaped channel 117. As shown in FIG. 2D, the first lid portion 400 may be formed so as to have a generally U-shaped vertical (e.g., emplaced) cross-section with a convex upper surface and a concave lower surface, as shown in FIG. 2D, and may be snapped into place, screwed tight or snug fitted when engaged. FIG. 2E shows an overhead view example of an alternate lid or cap 405 with an extension eye (to be tethered to or placed onto one of the peripheral hooks of the umbrella stand and table system when said cap is unengaged) in accordance with various aspects of the present disclosure.

Additionally, the combination umbrella stand and table system 100 may also be configured to include a second lid portion 300, as shown in FIG. 4, wherein second lid portion 300 may be configured to be selectively engageable with the stand housing (e.g., housing 102 of FIG. 1A such as after the ballast has been received within the concave area 103 thereof). When the second lid portion 300 is selectively engaged with the stand housing 102 (FIG. 1A), the second lid portion 300 may seal or otherwise close or partially close the concave area 103 (FIG. 1A) at the first walled end 106 (FIG. 1A) of the stand housing 102 (FIG. 1A). Further, the second lid portion 300 may be configured to have an opening 305 therewithin, such that opening 305 of the second lid portion 300 may be in communication with the channel 117 of FIG. 1A (e.g., with the first lid portion removed) of the securing body 112 of FIG. 1A, when the second lid portion 300 is selectively engaged with the stand housing 102 of FIG. 1A. In one example, when the second lid portion 300 may be selectively engaged with the stand housing 102 (FIG. 1A) so as to thereby form a table surface or other similar platform, such that the table surface allows for the placement of food, drinks, cellular telephones, books, glasses, or other similar personal belongings or materials. Such use may occur, for example, while the umbrella (e.g., umbrella 128 of FIG. 2B) is engaged therewith via the umbrella pole (e.g., umbrella pole 128*a* of FIG. 2B) being received in the second opening 117 (FIG. 1A) of the securing body 112 (FIG. 1A), such that the umbrella (e.g., umbrella 228 of FIG. 2B) is able to selectively provide protection from the shade or other elements with regard to the user of the system 100 (FIG. 1A).

Also as shown in FIG. 4, the second lid portion 300 may include, for example, proximal to the center of the lid 300, a slightly elevated circular open button area 307, and ribbing may be provided externally and internally to the opening 305 to removably retain or assist in retaining the first lid portion 400 (FIG. 2C) or 405 (FIG. 2E) and the second lid portion 300 when engaged about the second opening 117 (FIG. 1A) of the securing body 112 (FIG. 1A). On the periphery of the second lid portion 300, one or more slots 309 may be located to retain the first lid portion 400 (FIGS. 2C and 2D) and/or one or more of the fitting rings 326 (FIG. 3), when not in use; also, other items, such as wallets, cellular telephones, and/or keys may similarly be retained thereby. Additionally, peripheral hooks, clips, or other retaining devices 311 may be located about the periphery of the lid 300 or elsewhere on the lid 300, to retain small shovels, drinking cups, the cap, latches, and/or other such items. The periphery of the lid 300 may have an outer elevated rim 399 (FIG. 4), which may similarly be used with a corresponding upper lid portion of a dual-layered table top (see, e.g., lid 800 of FIG. 8).

Figure 6:
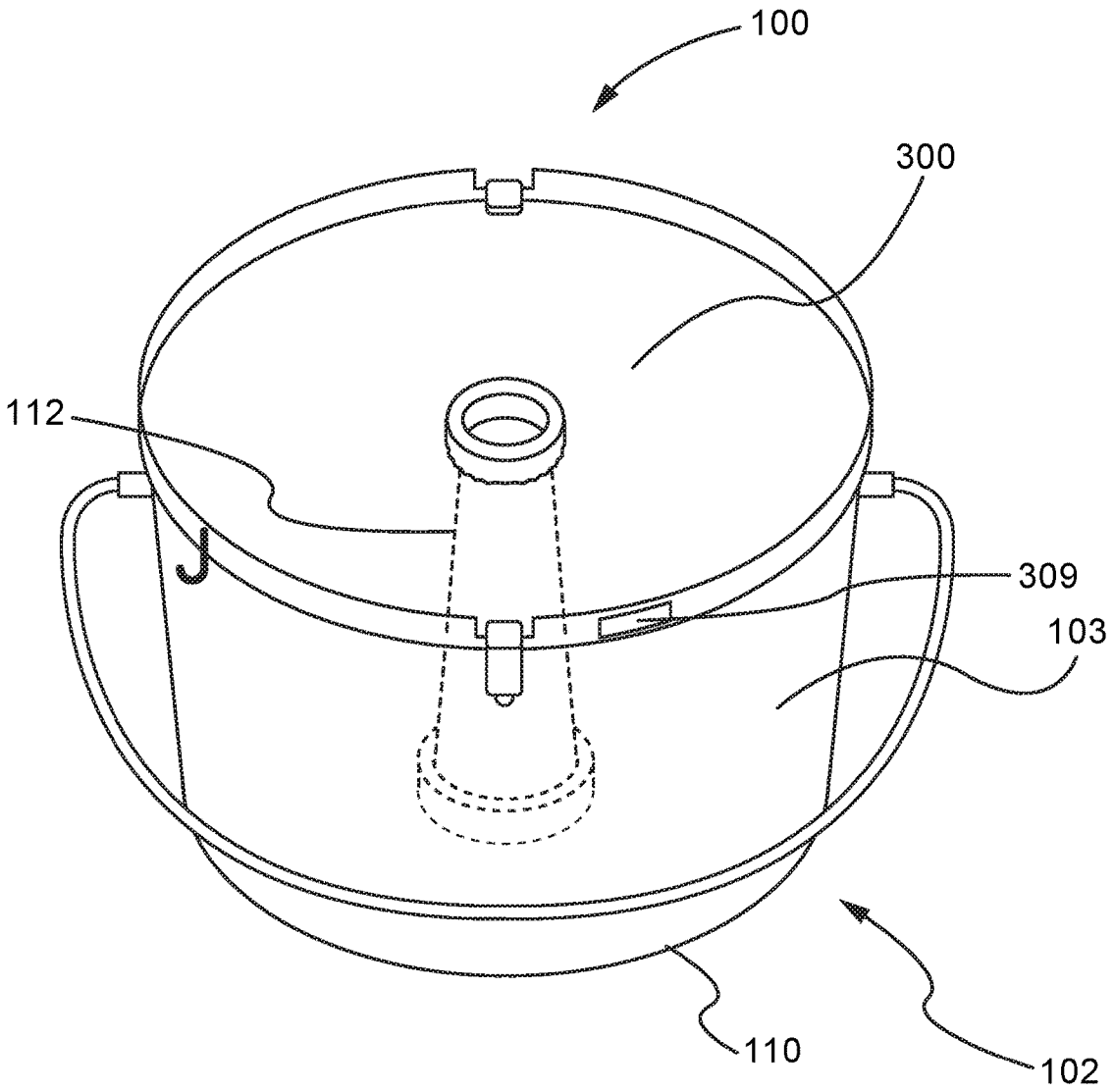
FIG. 6 shows another view of an example combination umbrella stand and table system, having ballast removed from the housing, and with the second lid portion received thereon, in accordance with aspects of the present disclosure.

FIG. 5 shows another view of an example portable beach and lawn bucket umbrella stand and snack table system 100, similar to the view of FIG. 2A, but with the housing 102 shown with ballast received within the inner housing portion 103, and with the securing body 112 having a cap 400 (shown in see-through view) emplaced thereon. The system 100 may be readied (e.g., via removal of the cap 400) to receive the table lid 300 (FIG. 4) or 800 and 900 (FIG. 8 and FIG. 9) and an umbrella pole within the channel 117 therein. After use, for example, as shown in FIG. 6, the umbrella pole may be extracted from the channel 117 in the securing body 112, the umbrella stand and snack table 100 may be emptied of ballast, and the second lid 300 (or 800 and 900 of FIG. 8 and FIG. 9) emplaced. The housing 102 may then further be used, for example, for storage or other items for transport or storage. Multiple systems may also be stacked and stored, as may lids. An opening for a screw 134 may be located at a position under the first lid portion/cap 400 (e.g., at the upper end of the securing body 112 as shown in FIG. 5) when the first lid/cap 400 is engaged with the second opening 117.

FIG. 7A shows a view (as viewed when emplaced for use to support an umbrella) of the lower end surface of an example umbrella stand and snack table system 100, such as is shown in FIG. 1A. As shown, the system 100 includes a securing body 112 with a channel 117 therein, the channel 117 extending from a first end to a second end of the securing body 112. The system 100 is further shown as having a recessed shelf 928 visible within the channel 117 in the securing body 112.

Figure 7B:
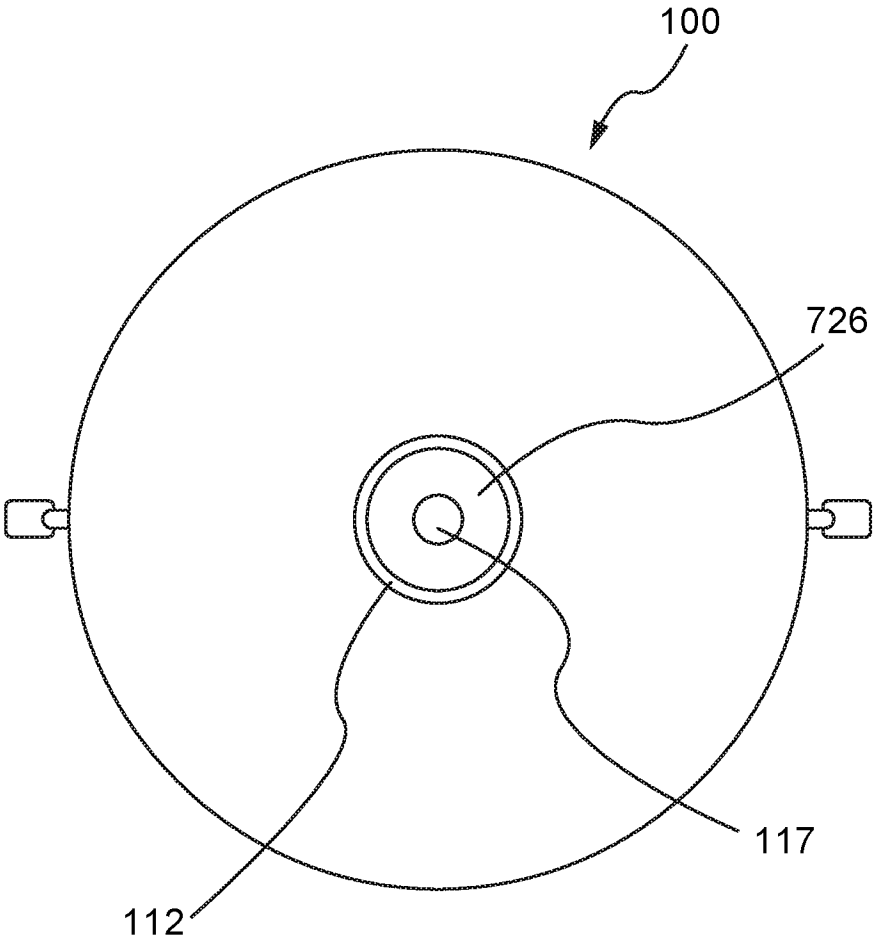
FIG. 7B shows another view of portable beach and lawn bucket umbrella stand and snack table system, with an example (e.g., lower, bucket interface) fitting ring located within the recessed shelf in the channel of an example securing body, in accordance with aspects of the present disclosure.

FIG. 7B shows another view of the example system 100 of FIG. 7A, with a fitting ring 726 (which may be similar to one of rings 326*d*, 326*e*, or 326*f* as shown in FIG. 3) located onto the previously visible recessed shelf 928 in the channel 117 of the securing body 112 (FIG. 7A). A plurality of fitting rings (see, e.g., rings 326 shown in FIG. 3) may be provided, having a plurality of sized openings therein, for selective use, as appropriate, for a correspondingly sized umbrella pole to be received therein.

Figure 8:
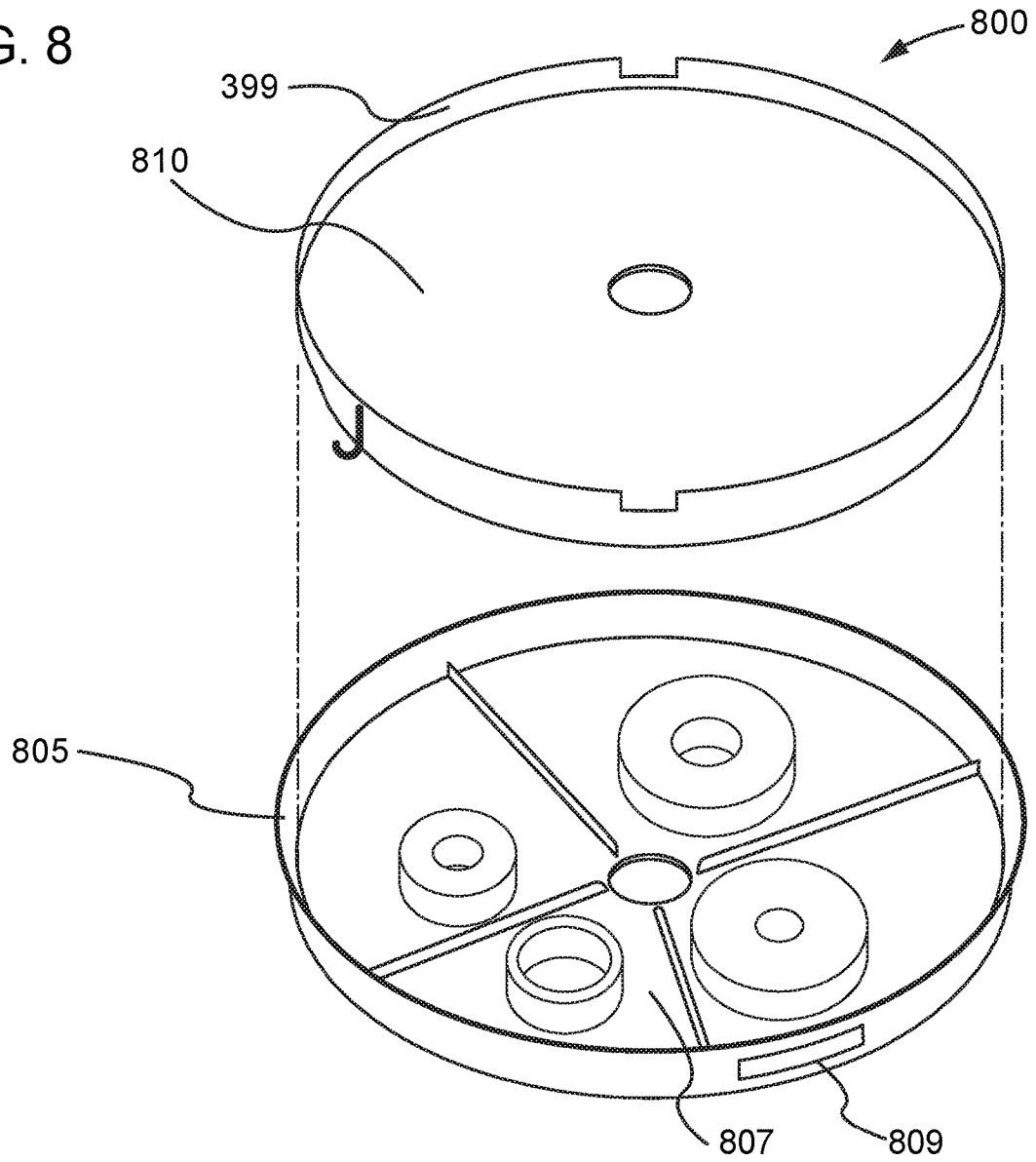
FIG. 8 shows another variation of an example housing enclosing (e.g., dual layer) lid for use with an example combination umbrella stand and snack table system, in accordance with aspects of the present disclosure.

FIG. 8 shows another variation of a second lid 800 for use with an example system (e.g., system 100 of FIG. 1A), in accordance with aspects of the present disclosure. In the disassembled view of the variation of the lid 800 shown in FIG. 8, the lid 800 includes a lower lid portion 805 having one or more receptacle/storage areas 807 located therein. In one example implementation, the storage areas 807 may be divided into pie-shaped subsections via dividing ridges or other features. Such storage areas 807 may be used, for example, to retain example upper and lower fitting rings, hooks, lid cap, and/or latches for selective use in securing the lid 800 to the system (e.g., system 100 of FIG. 1A), and/or other removable components; also, other items, such as wallets, cellular telephones, and/or keys may similarly be retained thereby, in a manner so as to avoid the heat/direct sunlight and to be out of view. The lower lid portion 805 may include, for example, one or more opening(s) 809 for allowing access to the storage area and/or items contained or placeable therein. Also shown is an upper lid portion 810 that may serve as a table top surface when installed and in use with the system (e.g., system 100 of FIG. 1A); the periphery of the lid portion 810 may have an outer elevated rim. The lower lid portion 805 may be snap-fit or otherwise engaged with the upper lid portion 810 so as to form an interconnected single combined lid 800 having a recess or recesses 807 therebetween.

Figure 9:
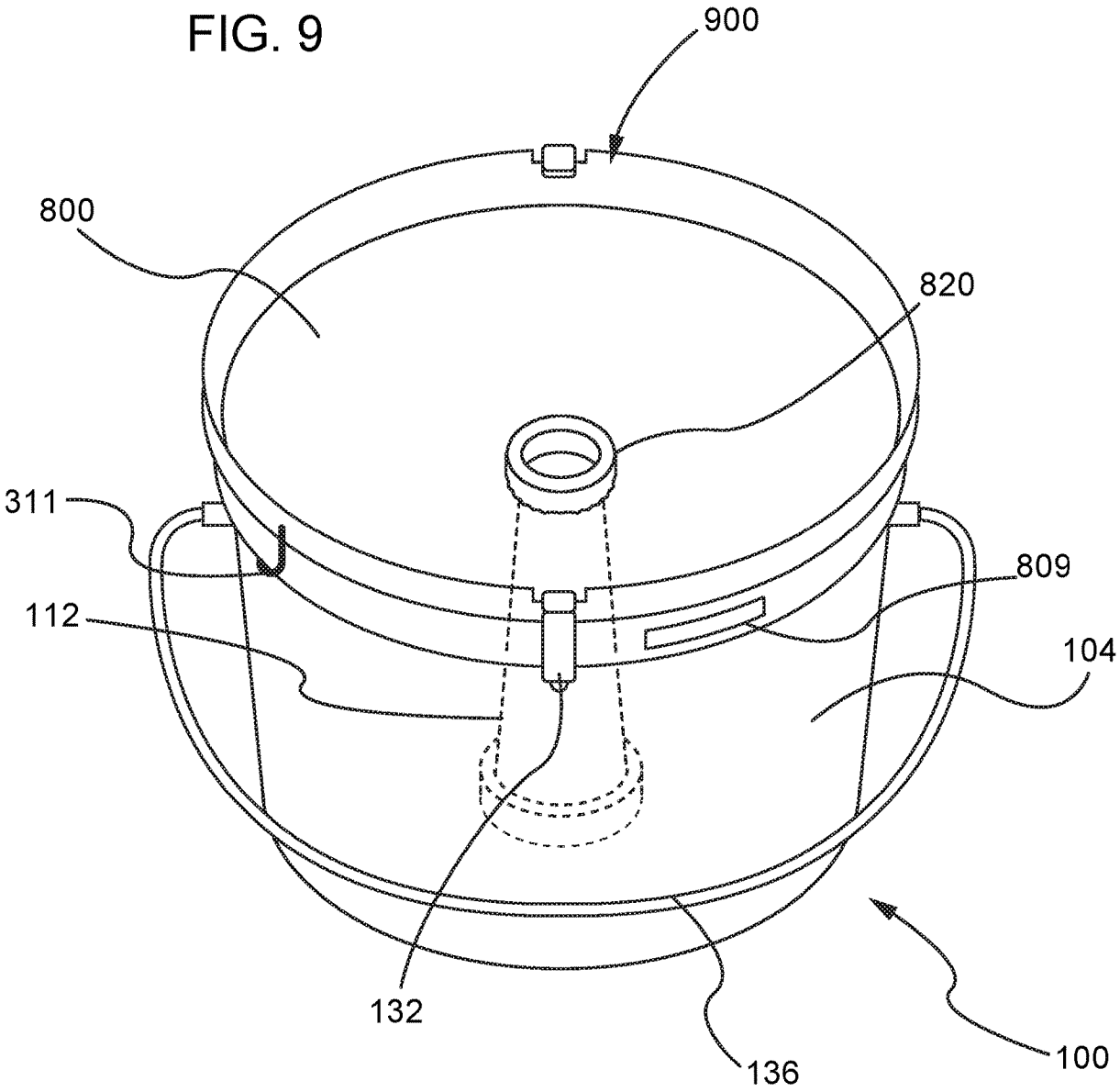
FIG. 9 shows a visible view of the assembled (e.g., dual layer) of lid of FIG. 8, in use with an example system to form a combined system and lid, in accordance with aspects of the present disclosure.

FIG. 9 shows a visible view of the assembled of lid 800 of FIG. 8, in use with an example system (e.g., system 100 of FIG. 1A) to form a combined system and lid 900, in accordance with aspects of the present disclosure. In the view of FIG. 9, the lid 800 (e.g., dual-layered) is shown having a formed opening 820 that corresponds to the securing body 112 received therein. The formed opening 820 may surround an umbrella pole received therethrough, into the securing body 112. The lower portion of the assembled lid 800 may have a circumferential shape sized to be received within the housing 104 of system 100, and opening 809 may be accessible when the assembled lid is engaged with the housing 104. The lower portion of the lid 800 may, for example, have a slight interference fit with the housing 104 when received therein. This example system 100 with the lid 800 emplaced may be stackably engaged with another housing not having a lid emplaced. In addition, multiple lids (e.g., lid 800) may also be stackable upon one another, such as for saving space for shipping or storage. Also shown in the assembled view of the system with lid 900 (of FIG. 9) are example emplaced hooks, latches in a securing positing, and a bucket handle.

The various components described herein may be constructed of such suitable materials and by appropriate processes for the component described. Such appropriate processes may include, for example, molding, dipping forging, casting, etc., depending on the materials used, as are known in the art.

Thus, the claims are not intended to be limited to the aspects shown herein, but are to be accorded the full scope consistent with the language of the claims, wherein reference to an element in the singular is not intended to mean "one and only one" unless specifically so stated, but rather "one or more." All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed as a means plus function unless the element is expressly recited using the phrase "means for."

Further, the word "example" is used herein to mean "serving as an example, instance, or illustration." Any aspect described herein as "example" is not necessarily to be construed as preferred or advantageous over other aspects. Unless specifically stated otherwise, the term "some" refers to one or more. Combinations such as "at least one of A, B, or C," "at least one of A, B, and C," and "A, B, C, or any combination thereof" include any combination of A, B, and/or C, and may include multiples of A, multiples of B, or multiples of C. Specifically, combinations such as "at least one of A, B, or C," "at least one of A, B, and C," and "A, B, C, or any combination thereof" may be A only, B only, C only, A and B, A and C, B and C, or A and B and C, where any such combinations may contain one or more member or members of A, B, or C. Nothing disclosed herein is intended to be dedicated to the public regardless of whether such disclosure is explicitly recited in the claims.

The invention claimed is:

1. A combination umbrella stand and table system, the system comprising:

a stand housing forming a concave area, the housing including:

an outer wall portion extending from a first walled end to a second walled end;

a closed end portion extending from the second walled end of the outer wall portion; and a conically outer shaped umbrella securing body extending along a central axis within the concave area, the securing body extending from a first end contiguous with the closed end portion to a second end, the securing body having a channel extending along the central axis from a first opening located at the first end of the securing body to a second opening at the second end;

a first lid portion releasably engageable with the second end of the securing body so as to prevent ingress of sand or other ballast into the channel during receipt of the sand or other ballast within the concave area of the stand housing; and a second lid portion releasably engageable to connect to the stand housing so as to close the concave area at the first walled end of the housing, the second lid portion having an opening therein that aligns with the second opening of the securing body when the second lid portion is releasably engaged with the stand housing.

2. The system of claim 1, wherein the second lid portion when engaged with the stand housing forms a table surface.

3. The system of claim 1, wherein the channel is at least partially tapered from a larger cross-sectional diameter proximal to the first end of the channel to a smaller cross-sectional diameter along the axis toward the second end of the channel.

4. The system of claim 3, further comprising:

a plurality of securing ring portions, each of the plurality of securing ring portions being selectively engageable with the securing body at the first end and/or the second end so as to at least partially close the first end and/or the second end of the channel.

5. The system of claim 4, further comprising a recess, hook, or clip configured to retain one or more of the securing ring portions.

6. The system of claim 5, wherein at least one of the recess, hook, or clip is located within the second lid portion.

7. The system of claim 4, wherein each of the plurality of securing ring portions has an opening therein, each of the plurality of openings having a circular shape;

wherein each of the plurality of openings has a different diameter; and wherein the plurality of differing diameter openings are each sized to correspond with a correspondingly sized outer shaft diameter of an umbrella received therein.

8. The system of claim 7, further comprising an umbrella having an umbrella pole, the umbrella pole being selectively receivable within the channel of the umbrella securing body within at least one of the plurality of securing ring portions.

9. The system of claim 3, wherein the stand housing is stackably engageable with a second stand housing via insertion of the securing body of the stand housing into the at least partially tapered channel of the second stand housing.

10. The system of claim 1, further comprising a handle attached to the stand housing.

11. The system of claim 1, wherein the second lid portion is multi-layered, having at least a second lid upper portion and a second lid lower portion, the second lid upper portion and the second lid lower portion being selectively securable to one another so as to form a recess therebetween.

12. The system of claim 11, wherein the recess and upper end portion is configured to protectively receive at least one selected from a group consisting of the first lid portion, at least one of a plurality of securing ring portions, a wallet, a cellular telephone, and a key.

13. The system of claim 1, further comprising at least one latch for selectively latching the second lid portion to the stand housing.

14. The system of claim 1, further comprising an umbrella having an umbrella pole, the umbrella pole being selectively receivable within the channel of the umbrella securing body.

15. The system of claim 1, wherein the second lid portion includes a raised button portion surrounding the opening in the second lid portion.

16. The system of claim 1, wherein the first lid portion is securably engageable with the second end of the securing body via at least one securing feature.

17. The system of claim 16, wherein the at least one securing feature includes at least one raised rib in the umbrella securing body or the first lid portion.

18. The system of claim 1, wherein the first lid portion has an eye extension attached thereto.

19. The system of claim 1, wherein the first lid portion has a circular cross-sectional shape and includes a concave portion.

20. The system of claim 1, wherein the second lid portion is securably engageable with the outer wall portion of the stand housing.

21. A combination umbrella stand and table, the combination umbrella stand and table comprising:

a stand housing forming a concave area, the housing including:

an outer wall portion extending from a first walled end to a second walled end;

a closed end portion extending from the second walled end of the outer wall portion; and a conically outer shaped umbrella securing body extending along a central axis within the concave area, the securing body extending from a first end contiguous with the closed end portion to a second end, the securing body having a channel extending along the central axis from a first opening located at the first end of the securing body to a second opening at the second end;

ballast received within at least a portion of the concave area of the stand housing;

a lid portion releasably engageable with the stand housing so as to close the concave area at the first walled end, the second lid portion having an opening therein, the opening in the second lid portion aligning with the second opening of the securing body when the second lid portion is engaged with the stand housing; and an umbrella having an umbrella pole and a canopy, the umbrella pole being received within the channel of the umbrella securing body.

22. A combination umbrella stand and table system, the system comprising:

a first stand housing forming a concave area, the first housing including:

an outer wall portion extending from a first walled end to a second walled end;

a closed end portion extending from the second walled end of the outer wall portion; and a conically outer shaped umbrella securing body extending along a central axis within the concave area, the securing body extending from a first end contiguous with the closed end portion to a second end, the securing body having a channel extending along the central axis from a first opening located at the first end of the securing body to a second opening at the second end;

wherein a first lid portion releasably engageable with the second end of the securing body so as to prevent ingress of sand or other ballast into the channel during receipt of the sand or other ballast within the concave area of the stand housing; and wherein a second lid portion releasably engageable with the stand housing so as to close the concave area at the first walled end, the second lid portion having an opening therein, the opening in the second lid portion aligning with the second opening of the securing body when the second lid portion is engaged with the stand housing; and a second stand housing forming a concave area, the housing including:

an outer wall portion extending from a first walled end to a second walled end;

a closed end portion extending from the second walled end of the outer wall portion; and a conically outer shaped umbrella securing body extending along a central axis within the concave area, the securing body extending from a first end contiguous with the closed end portion to a second end, the securing body having an at least partially tapered channel extending along the central axis from a first opening located at the first end of the securing body to a second opening at the second end;

wherein the first stand housing is stackably engageable with a second stand housing via insertion of the securing body of the first stand housing into the at least partially tapered channel of the second stand housing.

* * * * *